US011583151B2

(12) United States Patent
Choi et al.

(10) Patent No.: US 11,583,151 B2
(45) Date of Patent: Feb. 21, 2023

(54) VACUUM CLEANER

(71) Applicant: Samsung Electronics Co., Ltd., Suwon-si (KR)

(72) Inventors: Jiwon Choi, Suwon-si (KR); Byoungjin Lee, Suwon-si (KR); Kihwan Kwon, Suwon-si (KR); Dongjun Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 211 days.

(21) Appl. No.: 16/997,802

(22) Filed: Aug. 19, 2020

(65) Prior Publication Data

US 2021/0052119 A1 Feb. 25, 2021

(30) Foreign Application Priority Data

Aug. 21, 2019 (KR) ..... 10-2019-0102183

(51) Int. Cl.
*A47L 9/04* (2006.01)

(52) U.S. Cl.
CPC ..... *A47L 9/0477* (2013.01); *A47L 9/0411* (2013.01); *A47L 9/0488* (2013.01); *A47L 2201/00* (2013.01)

(58) Field of Classification Search
CPC .... A47L 9/0477; A47L 9/0411; A47L 9/0488; A46B 9/08; A46B 9/10; A46B 9/12
USPC ..... 15/383
See application file for complete search history.

(56) References Cited

U.S. PATENT DOCUMENTS

2008/0086837 A1* 4/2008 Son ..... A47L 9/04 15/374
2010/0306957 A1* 12/2010 Follows ..... A46B 13/02 15/363
2016/0073841 A1* 3/2016 Eriksson ..... A47L 9/322 15/368

(Continued)

FOREIGN PATENT DOCUMENTS

JP 11318781 A * 11/1999
KR 200358817 Y1 8/2004

OTHER PUBLICATIONS

JP H11-318781 A Suction device for vacuum cleaner and vacuum cleaner (English), (Koichi, Fujita) Nov. 1999, [ip.com], [retrieved on Apr. 27, 2022], Retrieved from IP.com using internet <URL: https://iq.ip.com/discover/searchhistory?id=1860884> (Year: 1999).*

*Primary Examiner* — Joseph J Hail
*Assistant Examiner* — Timothy Brady

(57) ABSTRACT

A vacuum cleaner including: a cleaner body configured to generate a suction force; and a suctioner configured to have a brush drum rotatably provided on a suction port sucking foreign objects by the suction force. The brush drum includes a cylindrical drum, a blade assembly provided on an outer circumferential surface of the drum to extend along a rotational shaft direction, and a cleaning member provided on the blade assembly to clean dust or the foreign objects on a cleaning surface. The blade assembly includes a cleaning member support part configured to accommodate and support a part of the cleaning member and a stopper provided in the cleaning member at intervals to restrict the cleaning member from being deformed in an opposite direction to a rotational direction of the brush drum.

20 Claims, 15 Drawing Sheets

(56) References Cited

U.S. PATENT DOCUMENTS

2017/0347848 A1* 12/2017 Carter ..... A47L 5/30
2018/0255991 A1* 9/2018 Der Marderosian ..... A47L 11/4094
2019/0298126 A1* 10/2019 Conrad ..... A47L 9/0494

* cited by examiner

VACUUM CLEANER

CROSS-REFERENCE TO RELATED APPLICATION

This application is based on and claims priority to Korean Patent Application No. 10-2019-0102183 filed on Aug. 21, 2019 in the Korean Intellectual Property Office, the disclosure of which is incorporated by reference herein in its entirety.

BACKGROUND

1. Field

The present disclosure relates to a vacuum cleaner, and more particularly, to improvement in a structure of a brush drum of the vacuum cleaner.

2. Description of the Related Art

A vacuum cleaner includes a foreign object suction unit that has a brush drum to clean a floor such as a carpet where foreign objects are attached to a deep place. The brush drum hits targeted objects while rotating to separate foreign objects in a gap of the carpet or floor from the gap of the carpet or floor. The vacuum cleaner sucks the separated foreign objects through the foreign object suction unit. As described above, the brush drum is usefully used when suctioning foreign objects attached to a deep place between hairs of the carpet by making a suction port of the vacuum cleaner approach a surface of the carpet.

The brush drum includes a cleaning member provided on an outer circumferential surface thereof, for example, a drum provided with a bristle. However, the bristle provided on the drum has a structure that is vulnerable to tangles such as pet or human hair. In addition, the brush drum may have the bristle and rubber blades provided on an outer circumferential surface thereof. However, a work of assembling the rubber blades as well as the bristle on the drum during mass production is very inconvenient and complicated, and as a result, a working time becomes long, resulting in poor mass productivity. In addition, in the conventional brush drum structure, the ability to pick up and transfer the hair decreases and the problem with a tangled hair is still occurring.

SUMMARY

In order to resolve the problem of the conventional art, a vacuum cleaner with excellent mass productivity is provided.

Also, a vacuum cleaner capable of making ability to pick up and transfer a hair excellent and reducing tangle of a hair is provided.

Accordingly, an aspect of one or more embodiments may provide a vacuum cleaner for achieving the above object. The vacuum cleaner includes: a cleaner body configured to generate a suction force; and a suctioner configured to have a brush drum rotatably provided on a suction port sucking foreign objects by the suction force. The blade assembly includes a cylindrical drum, a blade assembly provided on an outer circumferential surface of the drum to extend along a rotational shaft direction, and a cleaning member provided on the blade assembly to clean dust or the foreign objects on a cleaning surface. The blade assembly includes a cleaning member support part configured to accommodate and support a part of the cleaning member, and a stopper provided in the cleaning member at intervals to restrict the cleaning member from being deformed in an opposite direction to a rotational direction of the brush drum.

The stopper may be configured to have a support surface facing the cleaning member, and an interval between the cleaning member and the support surface of the stopper may be configured to be gradually wide in a radial direction of a rotating shaft.

The blade assembly may be configured to spirally extend along the rotational shaft direction, and the blade assembly may include a blade support part accommodated and supported in the drum, and a base part configured to extend along a circumferential direction of the drum and the rotational shaft direction from the blade support part to be in contact with the outer circumferential surface of the drum, and support the stopper.

The cleaning member support part may include a groove part having a "reverse T"-shaped cross section that extends along an extending direction of the blade assembly in the base part.

The brush drum may include drum caps that are coupled to both end portions of the drum, and an end portion of the base part may be provided with an extended support part that is supported by the drum cap.

The both end portions of the base part of the blade assembly may be configured to adhere to the outer circumferential surface of the drum.

The base part of the blade assembly may have an arcuate cross section that extends in the circumferential direction of the drum.

The cleaning member may include a support part that is inserted into the groove part and a plurality of hairs or filaments that are supported by the support part and protrude.

The support part may have both end portions in the circumferential direction that have a thickness thinner than a central portion between the both end portions.

A height in a radial direction of a rotating shaft of the cleaning member may be higher than the stopper.

A length in the rotational shaft direction of the cleaning member may be longer than the stopper.

The stopper may include a locking jaw to which the support part is locked in a radial direction of a rotating shaft from the groove part.

The blade assembly may further include at least one blade spaced apart from the stopper.

An end portion of the blade may be provided with a protrusion that protrudes in a rotational direction or a reverse direction thereto.

The stopper may include a pair of stoppers spaced apart from each other, and the cleaning member is provided between the pair of stoppers.

The cleaning member may be provided in plural, and the cleaning member support part may be provided in plural while being spaced apart from each other in a circumferential direction to support the plurality of cleaning members, respectively.

The plurality of cleaning members may be the same type or different types of cleaning members.

The plurality of cleaning members may include a cleaning member that is made of a single or mixed material of fabric, rubber, bristle, carbon, nylon, or silver.

The cleaning member may be provided in plural, and the cleaning member support part may include a plurality of cleaning member passing parts into which the plurality of cleaning members are inserted.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 15, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, embodiments of a vacuum cleaner 1 will be described in detail with reference to the accompanying drawings. Embodiments described below have described a robot cleaner as an example to help understanding of the disclosure, but it should be understood that unlike the embodiments described herein, the vacuum cleaner may be implemented in various modifications such as a canister type vacuum cleaner, an upright type vacuum cleaner, and a stick type vacuum cleaner. However, when it is decided that a detailed description for the known functions or components related to the present disclosure may obscure the gist of the present disclosure, the detailed description and concrete illustration will be omitted.

Figure 1:
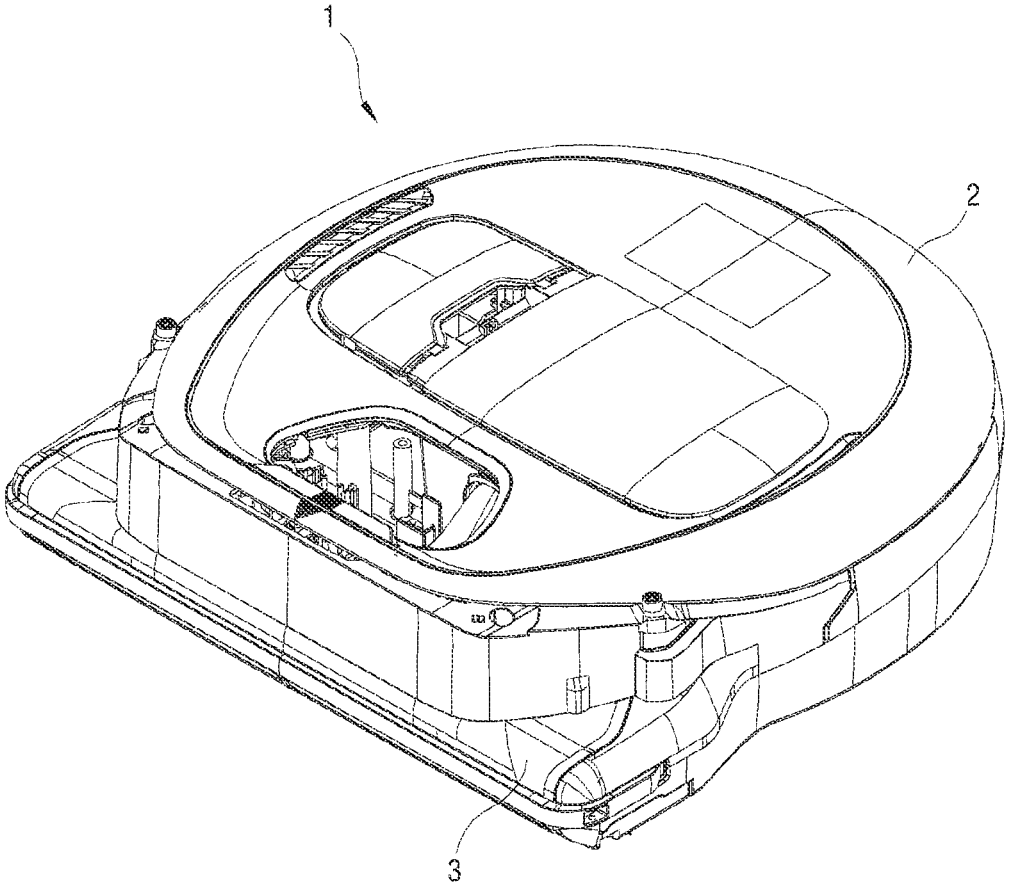
FIG. 1 is a perspective view illustrating an upper portion of a vacuum cleaner according to an embodiment of the present disclosure.
Figure 2:
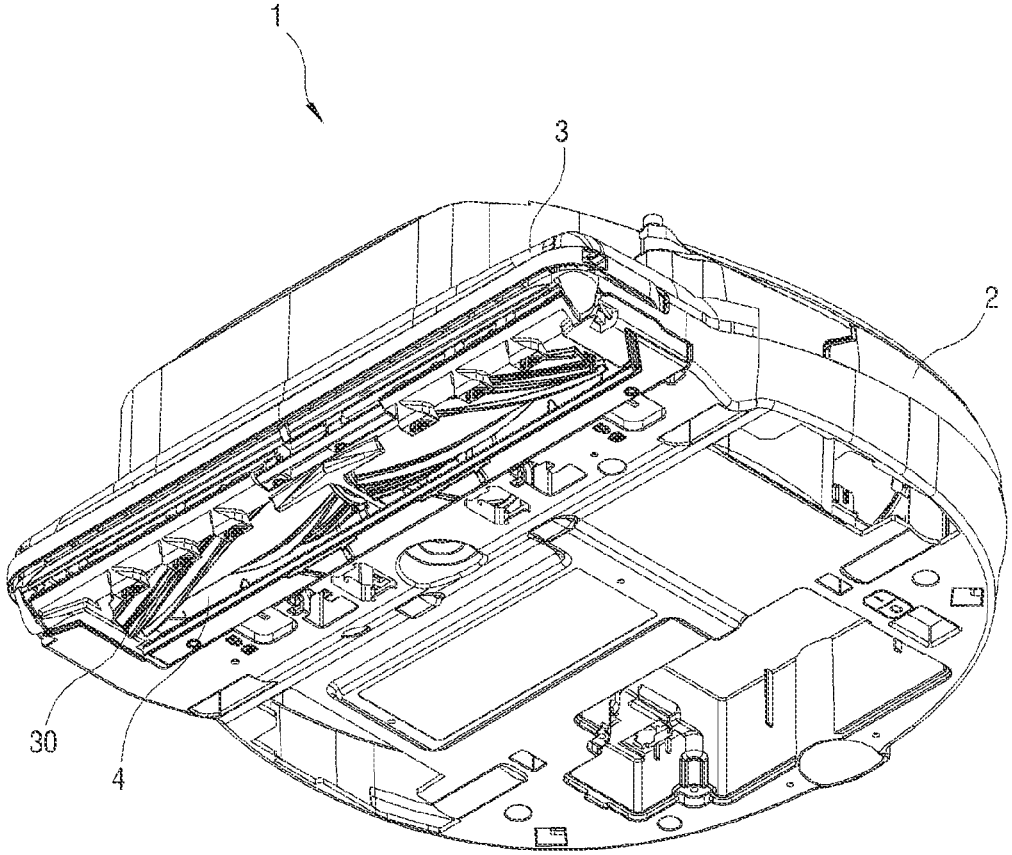
FIG. 2 is a perspective view illustrating a lower portion of the vacuum cleaner according to the embodiment of the present disclosure.

FIG. 1 is a perspective view illustrating an upper portion of the vacuum cleaner 1 according to an embodiment of the present disclosure, and FIG. 2 is a perspective view illustrating a lower portion of the vacuum cleaner 1 according to an embodiment of the present disclosure.

Referring to FIGS. 1 and 2, the vacuum cleaner 1 according to the embodiment of the present disclosure includes a cleaner body 2 generating a suction force and a suction unit 3.

The cleaner body 2 may include a suction motor generating the suction force and a dust collecting unit.

The suction motor may generate a predetermined suction force for sucking dust or foreign objects on a surface to be cleaned.

The dust collecting unit may collect dust or foreign objects sucked into the cleaner body 2 through the suction unit 3 by the suction force. The dust collecting unit may include a filter that filters dust or foreign objects sucked by the suction force. The dust collecting unit may include a cyclone structure that separates foreign objects from sucked air using a centrifugal force.

The suction unit 3 as a suctioner may include a brush drum 30 provided in a brush receiving part 4. The brush drum 30 may pick up and crush dust or foreign objects such as pet or human hair on a floor of a cleaning surface, for example, a carpet while rotating.

Figure 3:
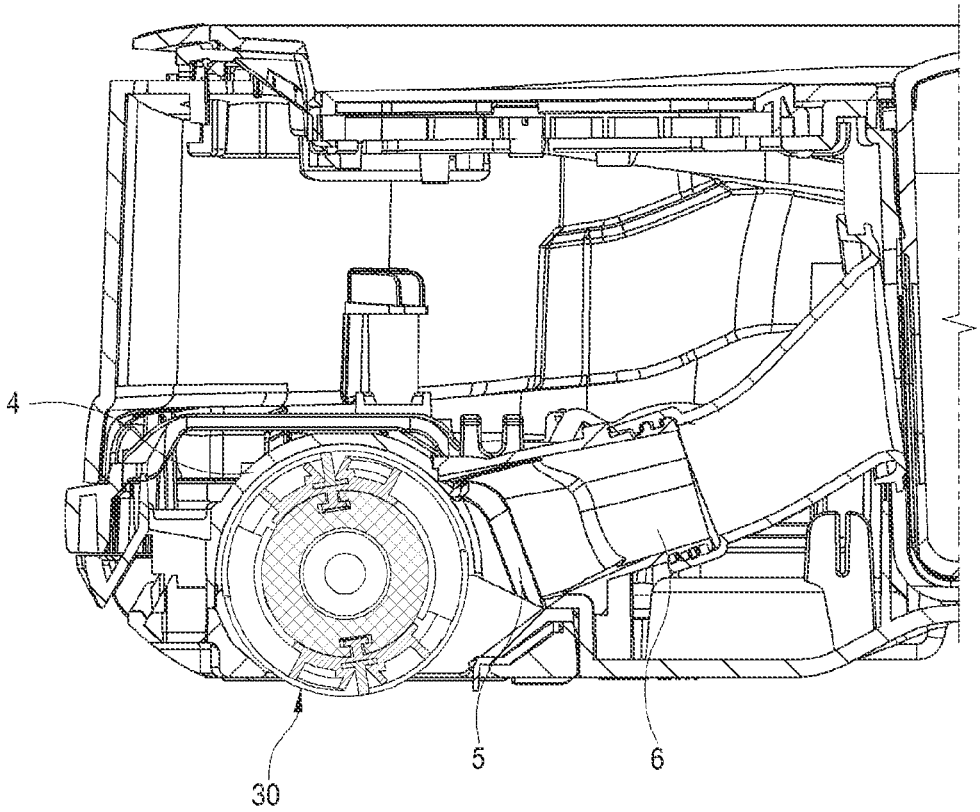
FIG. 3 is a cross-sectional view illustrating a suction unit of FIG. 2.

FIG. 3 is a cross-sectional view illustrating the suction unit 3 of FIG. 2.

Referring to FIG. 3, the suction unit 3 may include the brush drum 30 provided to rotate on a suction port 5 that suctions dust or foreign objects on the floor of the cleaning surface. The dust or foreign objects on the floor of the cleaning surface may be collected by the brush drum 30 and may be then sucked through the suction port 5 and a suction passage 6.

In general, dust or foreign objects deeply attached into a material such as a carpet is difficult to be sucked by simple suction of air. Therefore, the brush drum 30 shakes off dust or foreign objects deeply attached between a plurality of hairs on the carpet and scatters the dust or foreign objects to an upper portion of the carpet while rotating, so the scattered dust or foreign objects can be sucked into the suction port 5.

Figure 4:
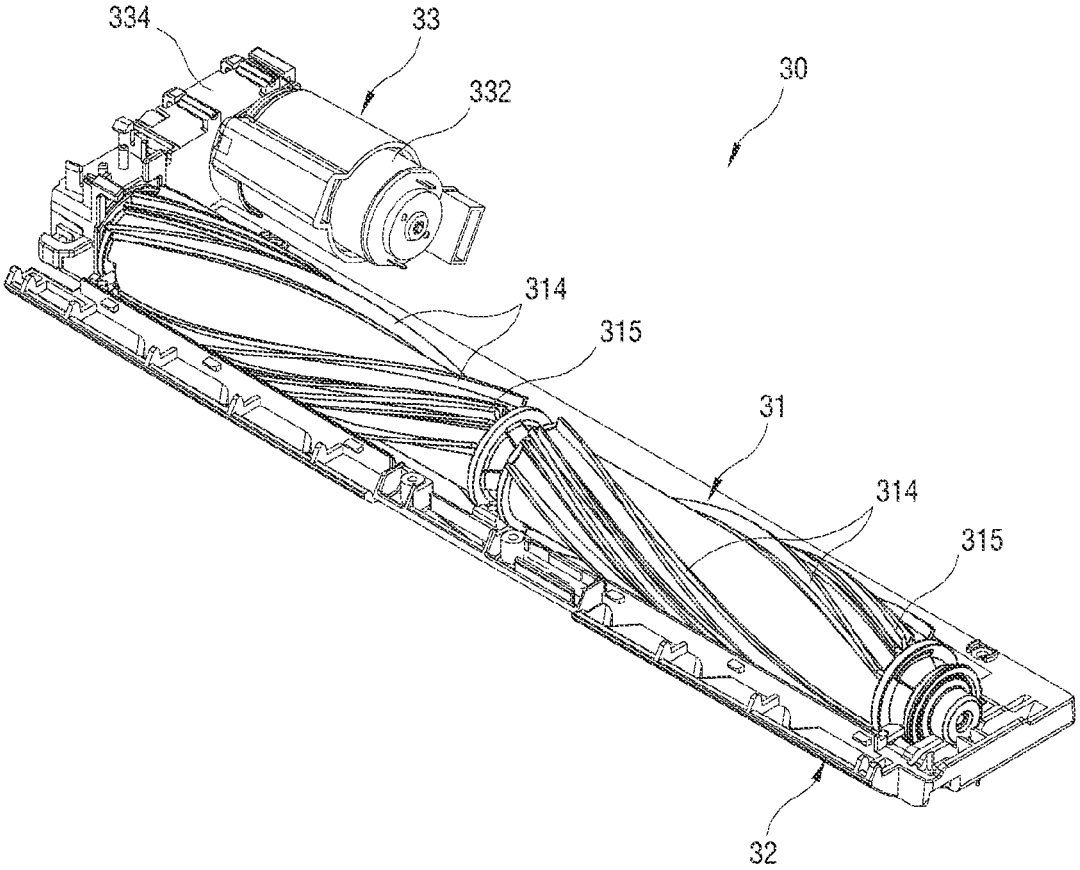
FIG. 4 is a perspective view of a brush drum of FIG. 3.

FIG. 4 is a perspective view of the brush drum 30 according to the embodiment of the present disclosure.

Referring to FIG. 4, the brush drum 30 may include a drum assembly 31, a grinding unit 32, and a drum driving unit 33.

The drum assembly 31 has a rotating cylindrical shape and can be collected by picking up the dust or foreign objects on the floor of the cleaning surface.

The drum assembly 31 may include a blade assembly 314 that is provided on the outer circumferential surface to spirally extend along a rotating shaft, and a cleaning member 315 that is supported by the blade assembly 314. The blade assembly 314 and the cleaning member 315 may clean dust or foreign objects on the floor of the cleaning surface while rotating.

The grinding unit 32 may crush the pet or human hair collected from the drum assembly 31.

The drum driving unit 33 may rotate the drum assembly 31 by transmitting power to the drum assembly 31. The drum driving unit 33 may include a motor 332 that generates rotational power and a power transmission unit 334 that transmits the rotational power of the motor 332 to the drum assembly 31.

The power transmission unit 334 may be implemented by a driving belt or a driving gear.

Figure 5:
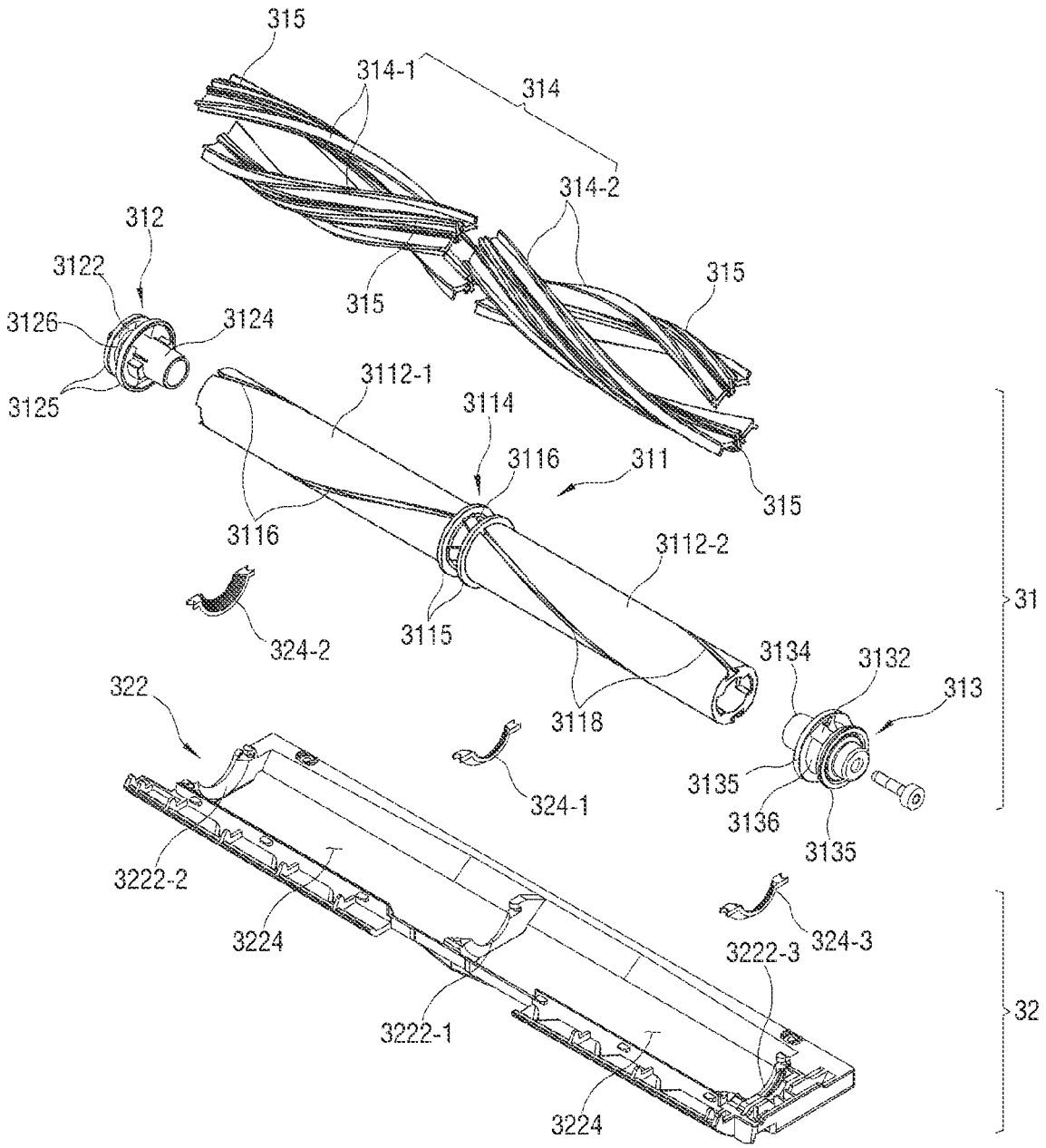
FIG. 5 is a perspective view illustrating a drum assembly and a grinding unit according to an embodiment of the present disclosure.
Figure 6:
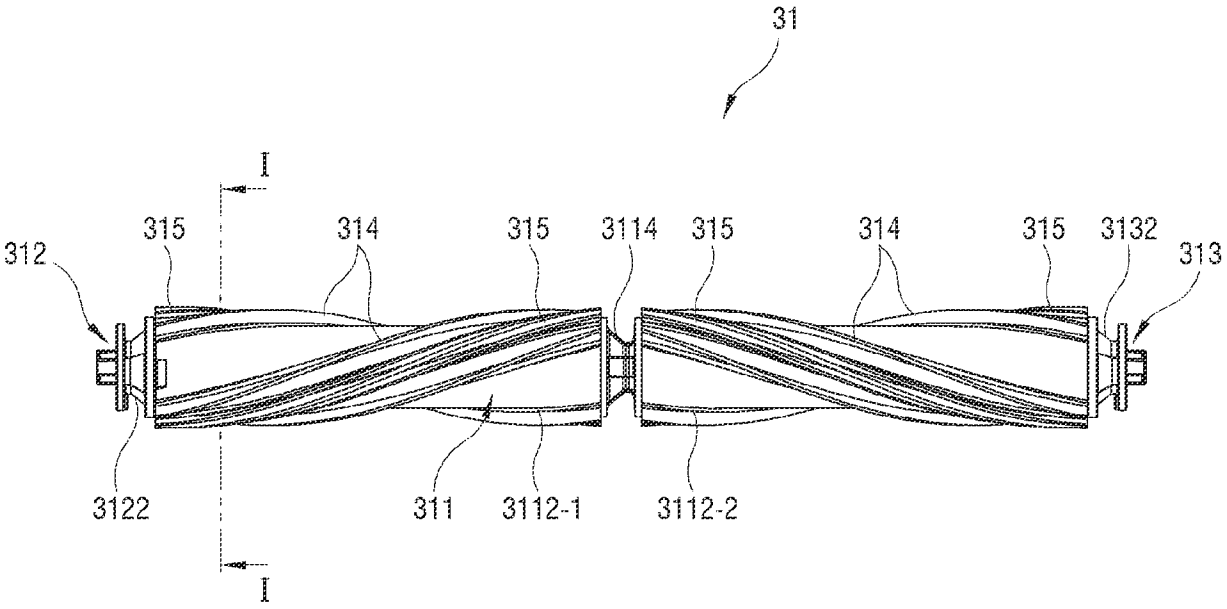
FIG. 6 illustrates a plan view of the drum assembly of FIG. 4.

FIG. 5 is an exploded perspective view of the drum assembly 31 and the grinding unit 32 according to the embodiment of the present disclosure, and FIG. 6 illustrates a plan view of the drum assembly 31 of FIG. 4.

Referring to FIG. 5, the drum assembly 31 may include a rotating body 311, first and second drum caps 312 and 313 that are fitted to both end portions of the rotating body 311, the blade assembly 314 provided on an outer circumferential surface of the rotating body 311, and the cleaning member 315 that is inserted into and supported by the blade assembly 314.

The rotating body 311 may include first and second drums 3112-1 and 3112-2 arranged in a line in a longitudinal direction and a first valley 3114 provided between the first and second drums 3112-1 and 3112-2. The rotating body 311 may be constituted by one drum or three or more drums. The rotating body 311 may be injection molded from plastic.

The first and second drums 3112-1 and 3112-2 may have a cylindrical shape, and may each include first and second blade mounting parts 3116 and 3118 that are provided on the outer circumferential surfaces thereof to spirally extend along the longitudinal direction. The first and second blade mounting parts 3116 and 3118 may accommodate and support the blade assembly 314. The first and second blade mounting parts 3116 and 3118 may be provided on each of the first and second drums 3112-1 and 3112-2 in one or three or more. The first and second blade mounting parts 3116 and 3118 may be formed of, for example, grooves having a 'reverse T'-shaped cross section.

The first valley 3114 may collect various hairs transferred and guided by the rotating blade assembly 314. The hair collected in the first valley 3114 may be crushed by a grinder 324-1 of the grinding unit 32 disposed adjacent to the valley 3114.

The first valley 3114 may collect various hairs transferred and guided by the blade assembly 314. The hair collected in the first valley 3114 may be crushed by a grinder 324-1 of the grinding unit 32 disposed adjacent to the first valley 3114.

The first valley 3114 may be integrally injection molded between the first and second drums 3112-1 and 3112-2 of the rotating body 311. The first valley 3114 may include a pair of first circular flanges 3115 that has a spool shape and spaced apart from each other, and for example, a first 'V'-shaped concave groove part 3117 that is provided in a circumferential direction between the pair of first circular flanges 3115. When the rotating body 311 is constituted by one drum, the first valley 3114 may be omitted. The first valley 3114 may be manufactured separately from the first and second drums 3112-1 and 3112-2 and coupled with the first and second drums 3112-1 and 3112-2.

In addition, the first 'V'-shaped concave groove part 3117 is not limited to the 'V' shape, and may be provided in various shapes such as a 'W' shape and a 'U' shape.

The first drum cap 312 may include a second valley 3122 and a first drum coupling part 3124.

The second valley 3122 may include a pair of second circular flanges 3125 that has a spool shape and spaced apart from each other, and for example, a second 'V'-shaped concave groove part 3126 that is provided in a circumferential direction between the pair of flanges 3125.

The first drum coupling part 3124 may be inserted into a hole provided at an end portion of the first drum 3112-1.

The second drum cap 313 may include a third valley 3132 and a second drum coupling part 3134.

The third valley 3132 may include a pair of third circular flanges 3135 that has a spool shape and spaced apart from each other, and for example, a third 'V'-shaped concave groove part 3136 that is provided in a circumferential direction between the pair of flanges 3135.

The second drum coupling part 3134 may be inserted into a hole provided at an end portion of the first drum 3112-2.

The blade assembly 314 may include first and second blade assemblies 314-1 and 314-2 that are fitted to the first and second blade mounting parts 3116 and 3118 provided on outer circumferential surfaces of the first and second drums 3112-1 and 3112-2, respectively. The first and second blade assemblies 314-1 and 314-2 may be inserted into the ends of the first and second drums 3112-1 and 3112-2, respectively, and pushed in the longitudinal direction. As illustrated in FIG. 6, the first and second blade assemblies 314-1 and 314-2 may be supported on the outer circumferential surfaces of the first and second drums 3112-1 and 3112-2, respectively, to spirally extend along a rotational shaft direction while protruding upwardly.

The cleaning member 315 may be inserted into and supported by the first and second blade assemblies 314-1 and 314-2 before the first and second blade assemblies 314-1 and 314-2 are inserted into the first and second drums 3112-1 and 3112-2.

The grinding unit 32 may include a base part 322 and three grinders 324-1 to 324-3.

The base part 322 covers a lower portion of the drum assembly 31. The base part 322 may include first to third grinder support parts 3222-1 to 3222-3 in a semicircular arc shape on which the first to third grinders 324-1 to 324-3 are each mounted, and a pair of drum lower receiving parts 3224 in the form of an opening in which lower portions of the first and second drums 3112-1 and 3112-2 are partially accommodated.

The first to third grinders 324-1 to 324-3 may be supported by the first to third grinder support portions 3222-1 to 3222-3 of the base part 322, respectively. The first to third grinders 324-1 to 324-3 may be disposed adjacent to each of the concave groove parts 3117, 3126, and 3136 of the first to third valleys 3114, 3122, and 3132, respectively. Accordingly, the first to third grinders 324-1 to 324-3 may crush foreign objects, for example, various kinds of hairs, which are picked up and guided by the first and second blade assemblies 314-1 and 314-2 when the drum assembly 31 rotates and then collected by the first to third valleys 3114, 3122, and 3132, by a frictional force. The crushed foreign objects may be sucked through the suction port 5 and the suction passage 6 by the suction force of the cleaner body 2.

The first to third grinders 324-1 to 324-3 may be made of abrasive stone, may be formed by diamond-coating surfaces thereof, or may have a joint for polishing formed on the surfaces thereof through rolling processing.

The foreign objects may be accumulated in a gap between the first to third grinders 324-1 to 324-3 and the first to third valleys 3114, 3122, and 3132. When the foreign objects accumulated in the gap exceeds a predetermined amount, the foreign objects may be crushed by friction with the first to third grinders 324-1 to 324-3. When the gap is formed too narrow, interference may occur due to vibrations of the first to third grinders 324-1 to 324-3 and the drum assembly 31.

The first to third grinders 324-1 to 324-3 are positioned on side surfaces of a pair of drum lower receiving parts 3224, which are positions corresponding to the first to third valleys 3114, 3122, and 3132, respectively.

The pair of drum lower receiving parts 3224 accommodate the lower portions of the first and second drums 3112-1 and 3112-2 with sufficient free space so that the first and second drums 3112-1 and 3112-2 can rotate while the lower portions of the first and second drums 3112-1 and 3112-2 being exposed to the outside. At this time, the exposed lower portions of the first and second drums 3112-1 and 3112-2 may contact and hit the floor of the cleaning surface while rotating, thereby separate dust or foreign objects from the floor of the cleaning surface.

Figure 7:
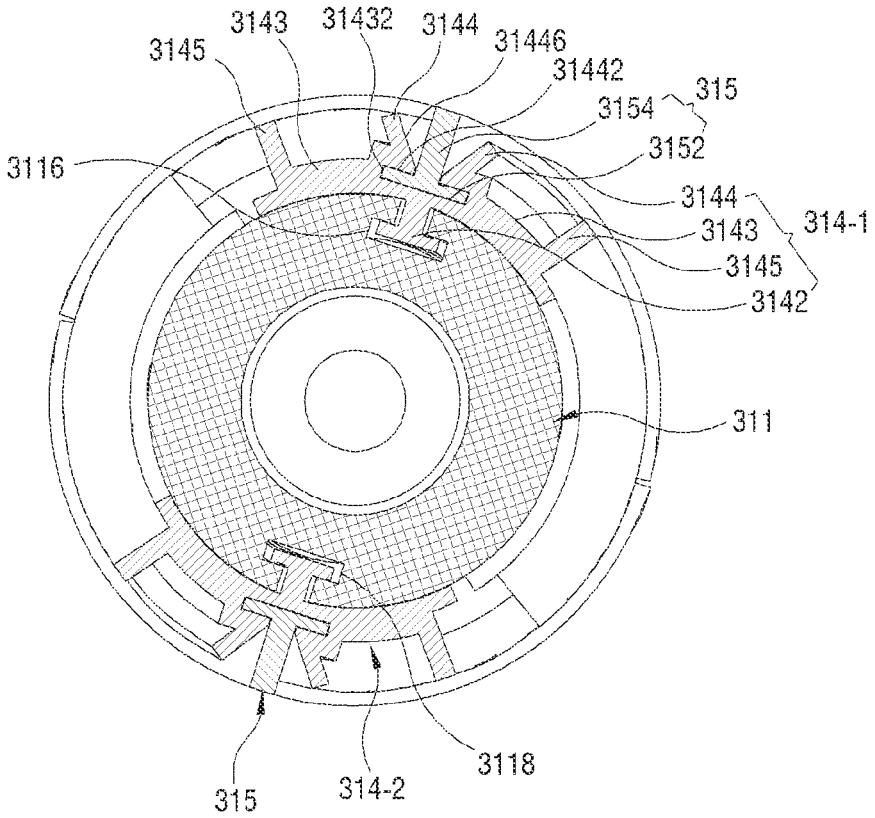
FIG. 7 illustrates a cross-sectional view taken along line I-I of FIG. 6.
Figure 8:
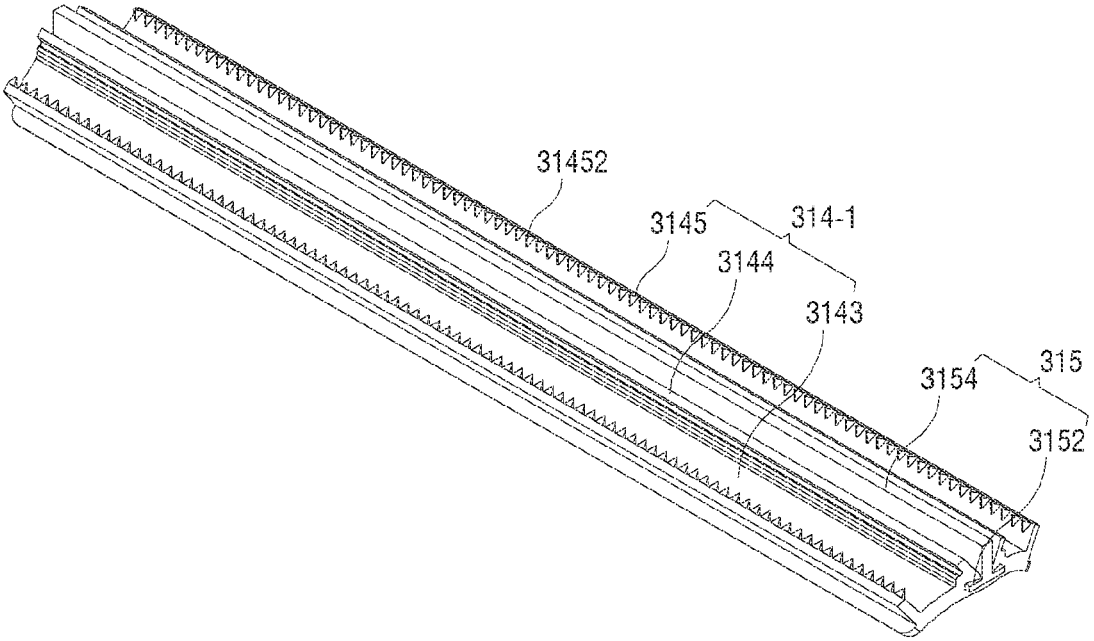
FIG. 8 illustrates a perspective view of the blade assembly of FIG. 7.
Figure 9:
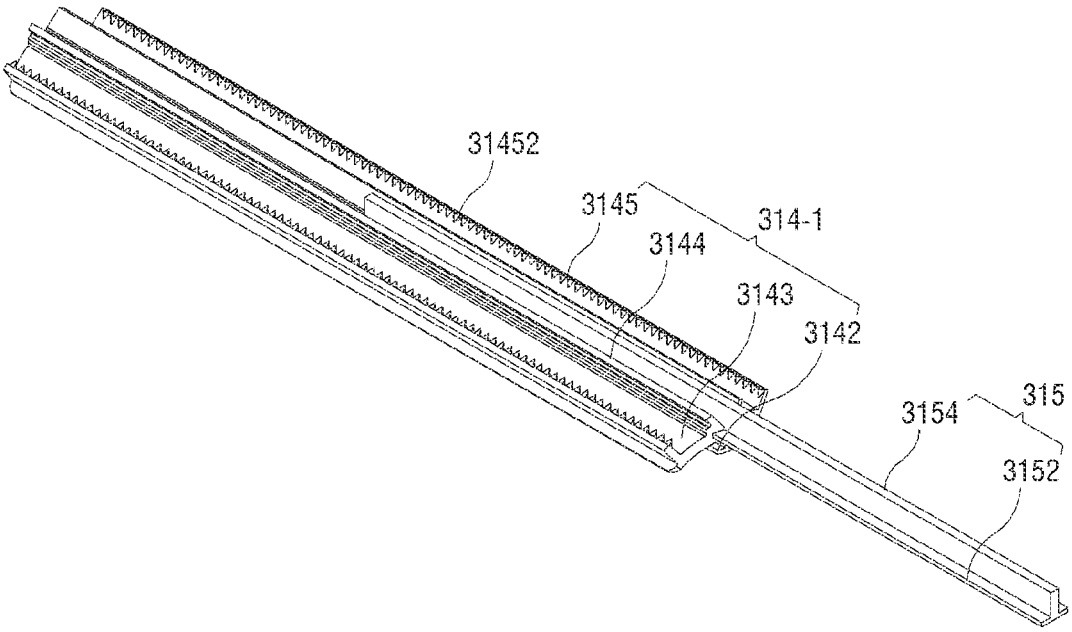
FIG. 9 is a perspective view illustrating a state in which a cleaning member is inserted into the blade assembly.

FIG. 7 illustrates a cross-sectional view taken along line I-I of FIG. 6, FIG. 8 illustrates a perspective view of the blade assembly 314 of FIG. 7, and FIG. 9 is a perspective view illustrating a state in which the cleaning member 315 is inserted into the blade assembly 314.

Referring to FIGS. 7 to 9, the first and second blade mounting parts 3116 and 3118 have a groove having a 'reverse T'-shaped cross section that is supported on the outer circumferential surface of the rotating body 311 to spirally extend along the rotational shaft direction, and the first and second blade assemblies 314-1 and 314-2 may be inserted into the first and second blade mounting parts 3116 and 3118.

Each of the pair of blade assemblies 314-1 and 314-2 may include a blade support part 3142 that is fitted to the first and second blade mounting parts 3116 and 3118 of the rotating body 311, a first base part 3143 having an arcuate cross section that extends in a radial direction of a rotating shaft from the blade support part 3142 and extends in both directions along a circumferential direction of the outer circumferential surface of the rotating body 311, a pair of stoppers 3144 that is erected in a center of the first base part 3143 at a first interval and extends side by side in the rotational shaft direction, and a pair of blades 3145 that is erected from the pair of stoppers 3144 at second and third intervals, respectively, extends side by side in the radial direction of the rotating shaft.

The pair of blade assemblies 314-1 and 314-2 may be made of an elastic material such as rubber. The blade assemblies 314-1 and 314-2 are manufactured linearly as illustrated in FIGS. 8 and 9 and may be fitted to the blade mounting parts 3116 and 3118 that spirally extend.

The blade support part 3142 may be disposed to extend along extending directions of the blade mounting parts 3116 and 3118 having a 'reverse T'-shaped cross section to be suitable for insertion into the 'reverse T'-shaped blade mounting parts 3116 and 3118.

The base part 3143 may include a cleaning member support part 31432 between the pair of stoppers 3144 at the center. The cleaning member support part 31432 has a 'reverse T'-shaped cross section, and may be implemented as a groove extending in a rotational shaft direction to correspond to the extending direction of the pair of stoppers 3144. A pair of locking jaws 31442 may be provided between the cleaning member support part 31432 and the stopper 3144 to support the cleaning member 315 so that the cleaning member 315 is prevented from being separated. An interval is formed between the pair of locking jaws 31442, and a hair or a filament 3154 of the cleaning member 315 may protrude from a groove of the cleaning member support part 31432 through the interval between the pair of locking jaws 31442.

The base part 3143 may have both end portions in the circumferential direction that have a thickness thinner than a central portion between the both end portions. In addition, both end portions of the base part 3143 may adhere to the outer circumferential surface of the rotating body 311. As described above, curling or lifting deformation due to use for a long time can be prevented by thinning both end portions of the base part 3143 than the central portion or making both end portions of the base part 3143 adhere to the central portion.

The stopper 3144 may include an inclined surface 31446 gradually spaced apart from the hair or filament 3154 of the cleaning member 315 in the radial direction of the rotating shaft. The stopper 3144 may limit a movable range in which the hair or filament 3154 of the cleaning member 315 moves to an opposite side to a rotational direction of the rotating body 311. That is, the hair or filament 3154 of the cleaning member 315 may contact the floor of the cleaning surface during rotation, move to the opposite side to the rotational direction of the rotating body 311, come into contact with the inclined surface 31446 of the stopper 3144, and then return to the original position. The movement of the hair or filament 3154 of the cleaning member 315 may effectively pick up dust or foreign objects, in particular, the pet or human hair.

In another embodiment, the stopper 3144 may have a vertical surface extending side by side at the same interval as the hair or filament 3154 of the cleaning member 315.

The stopper 3144 may not only serve to limit deformation of the hair or filament 3154 of the cleaning member 315, but also clean dust or foreign objects similar to the hair or filament 3154 of the cleaning member 315 or effectively pick up the pet or human hair.

The pair of blades 3145 may extend side by side while erected away from the pair of stoppers 3144 at second and third intervals, respectively. The pair of blades 3145 may serve, in particular, to clean dust or foreign objects on the cleaning surface such as a carpet, or to effectively pick up the pet or human hair, similar to the hair or filament 3154 of the cleaning member 315.

The end portions of the pair of blades 3145 may be provided with a plurality of protrusions (31452 in FIGS. 8 and 9) protruding in the rotational direction or a reverse direction thereto. The plurality of protrusions 31452 may easily pick up large chunks of pet or human hair.

The pair of blades 3145 and the protrusions 31452 may not come into contact with a hard floor of the cleaning surface.

As a modified embodiment, the blade assembly 314 may have one stopper 3144 provided on the opposite side of the rotational direction while being spaced apart from the cleaning member 315.

As a modified embodiment, the blade assembly 314 may be provided with one or three or more blades 3145.

As a modified embodiment, the rotating body 311 may be provided with one or three or more blade assemblies 314.

The cleaning member 315 may include a support part 3152 that extends in a rotational shaft direction and a circumferential direction in a form suitable for being inserted into a cleaning member support part 31432 and is longer in the rotational direction, and a plurality of hairs or filaments 3154 that is erected on the support part 3152 and extends along a center between the pair of stoppers 3144.

The support part 3152 can support the plurality of hairs or filaments 3154.

The plurality of hairs or filaments 3154 may be made of fabric, rubber (urethane), bristle, carbon, silver, nylon, or the like.

The cleaning member 315 may have a height greater than a radial height of the rotating shaft of the pair of stoppers 3144.

The cleaning member 315 may have a longer length in the rotational shaft direction than the stopper 3144 and the blade 3145.

Suitable ones for the cleaning environment among the cleaning members 315 that are made of a single or mixed material of fabric, rubber (urethane), bristle, carbon, silver, or nylon may be selected and applied to the brush drum 30 according to the embodiment of the present disclosure.

Figure 10:
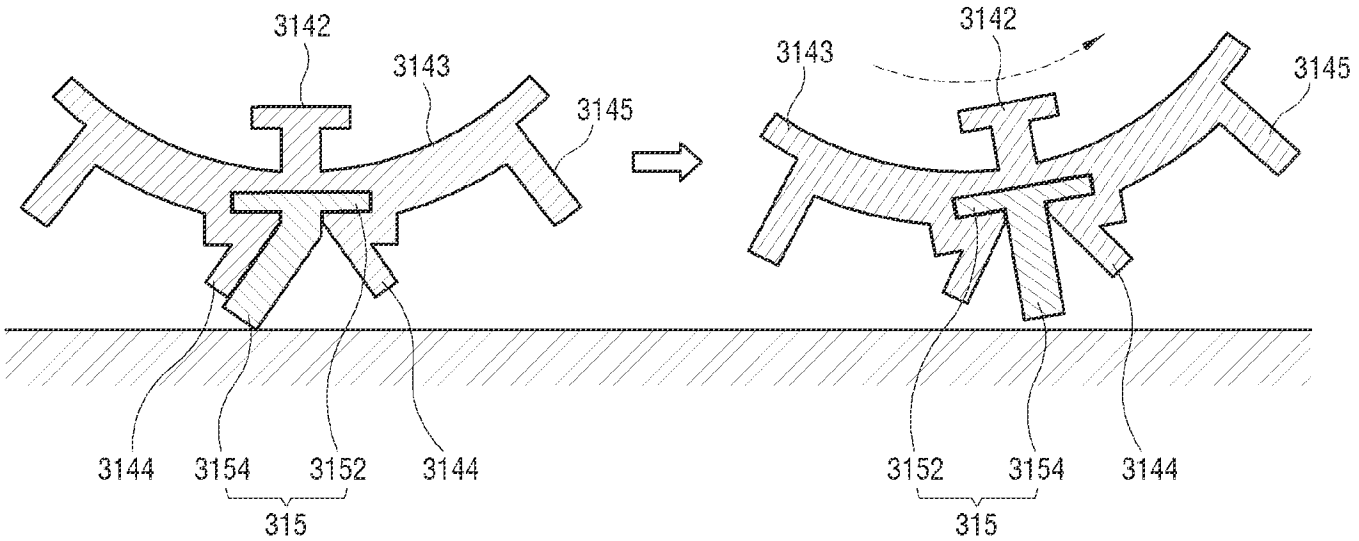
FIG. 10 illustrates a diagram for describing an operation of the cleaning member supported by the blade assembly.

FIG. 10 illustrates a diagram for describing an operation of the cleaning member 315 supported by the blade assembly 314.

Referring to FIG. 10, during the cleaning, the cleaning member 315 may be deformed in an opposite direction of a counterclockwise rotation as the cleaning member 315 comes into contact with the floor of the cleaning surface to be in contact with the stopper 3144. At this time, the cleaning member 315 is no longer deformed as the cleaning member 315 is limited by the stopper 3144. In this state, when the cleaning member 315 further rotates and is out of the floor of the cleaning surface, the cleaning member 315 may be restored to its original position. As a result, the cleaning member 315 may have a movable range in which the cleaning member 315 is repeatedly deformed and restored from its original position to the stopper 3144. The appropriate movable range of the cleaning member 315 may effectively pick up the pet or human hair while preventing durability damage due to over-deformation of the cleaning member 315.

Figure 11:
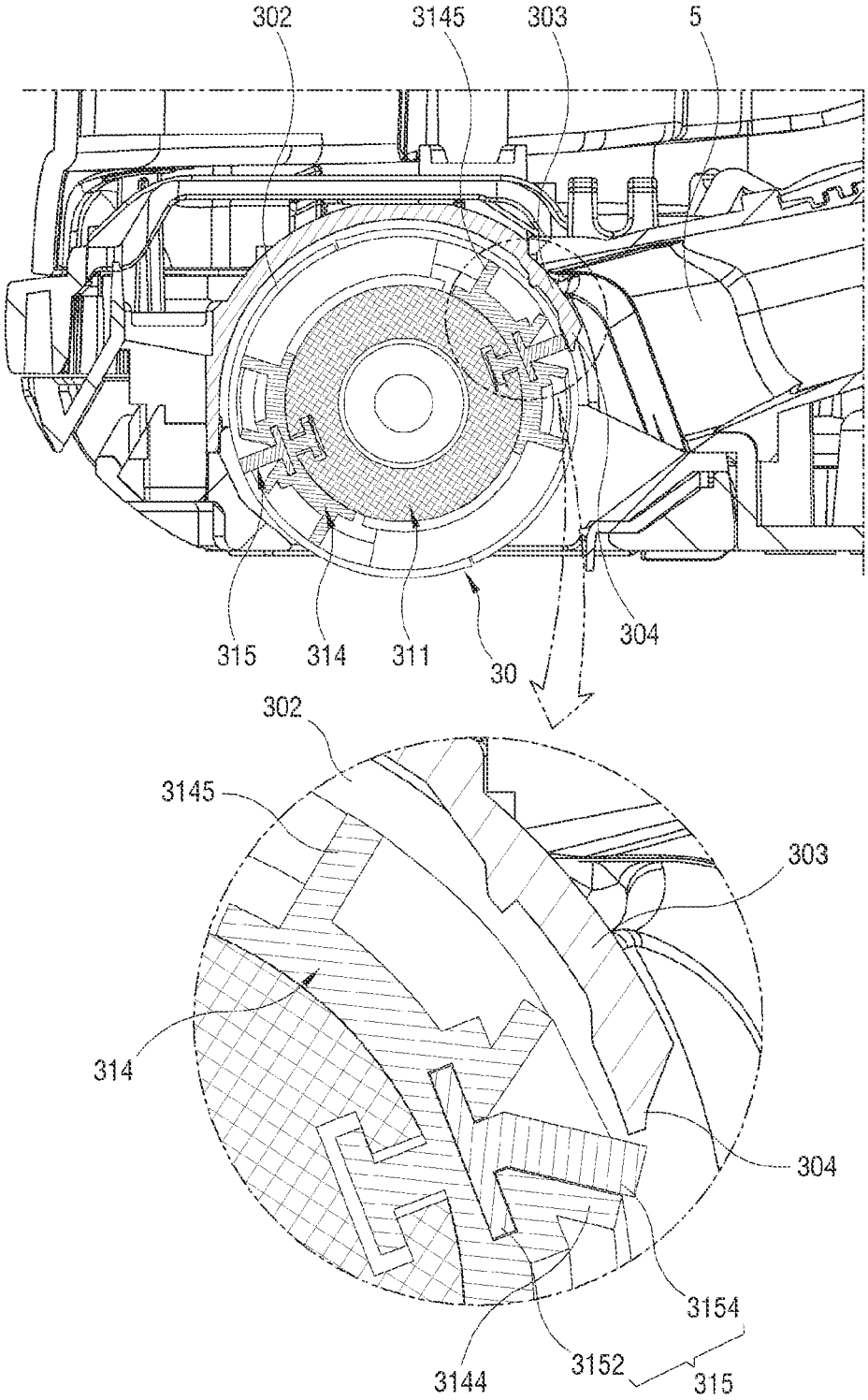
FIG. 11 illustrates a diagram for describing an operation of the brush drum applied to the vacuum cleaner according to the embodiment of the present disclosure.

FIG. 11 illustrates a diagram for describing an operation of the brush drum 30 applied to the vacuum cleaner 1 according to the embodiment of the present disclosure.

Referring to FIG. 11, the brush drum 30 may be provided in the drum receiving part 302 of the suction unit 3 so as to rotate in the suction port 5 for sucking dust or foreign objects. The drum receiving part 302 may include a housing 303 that partially encloses the rotating body 311 of the brush drum 30 at intervals. The housing 303 may include a scraper 304 at a tip of the suction port 5 side. As the cleaning member 315 of the rotating body 311 that is rotating is superposed on a scraper 304, foreign objects picked up by the cleaning member 315 may be peeled off and may be sucked into the suction port 5. That is, the scraper 304 may serve to peel off foreign objects picked up by the cleaning member 315.

Hereinafter, the cleaning process of the pet hair is as follows.

When the end portion of the cleaning member 315 provided on the outer circumferential surface of the drum assembly 31 falls after hitting the floor of the cleaning surface during the rotation, the pet hair existing on the floor of the cleaning surface may be picked up at the end portion of the cleaning member 315.

Subsequently, the picked-up pet hair does not reach a lower portion of the plurality of hairs or filaments 3154 by the stoppers 3144 provided at intervals, but is dug up to a height of the stopper 3144.

The pet hair that is not dug deeply as described above may be released by separating the plurality of hairs or filaments 3154 provided in the radial direction of the rotating shaft from each other once more by the rotating force and the scraper 304. As a result, the released pet hair may be sucked into the suction port 5.

Hereinafter, the cleaning process of the human hair is as follows.

When the end portion of the cleaning member 315 provided on the outer circumferential surface of the rotating brush drum 31 falls after hitting the floor of the cleaning surface during the rotation, the human hair existing on the floor of the cleaning surface may be picked up at the end portion of the cleaning member 315.

At this time, the picked-up human hair does not reach the lower portion of the plurality of hair or filaments 3154 due to the blade 3145 that is provided to be spaced apart from the stopper 3144, but is dug up to a height of the blade 3145.

The human hair that is not dug deeply and the human hair held by the plurality of hairs or filaments 3154 are released by the plurality of hairs or filaments 3154 due to the deformation of the stopper 3144 in the opposite direction of rotation as soon as the plurality of hairs or filaments 3154 come into contact with the scraper 304. At this time, the free human hair flows into the first to third valleys (3114, 3122, and 3132 in FIG. 5).

The human hair flowing into the first to third valleys 3114, 3122, and 3132 is strongly wound around the first to third valleys 3114, 3122, and 3132, and may be crushed by the first to third grinders (324-1 to 324-3 in FIG. 5) disposed on the other side and sucked into the suction port 5.

Figure 12:
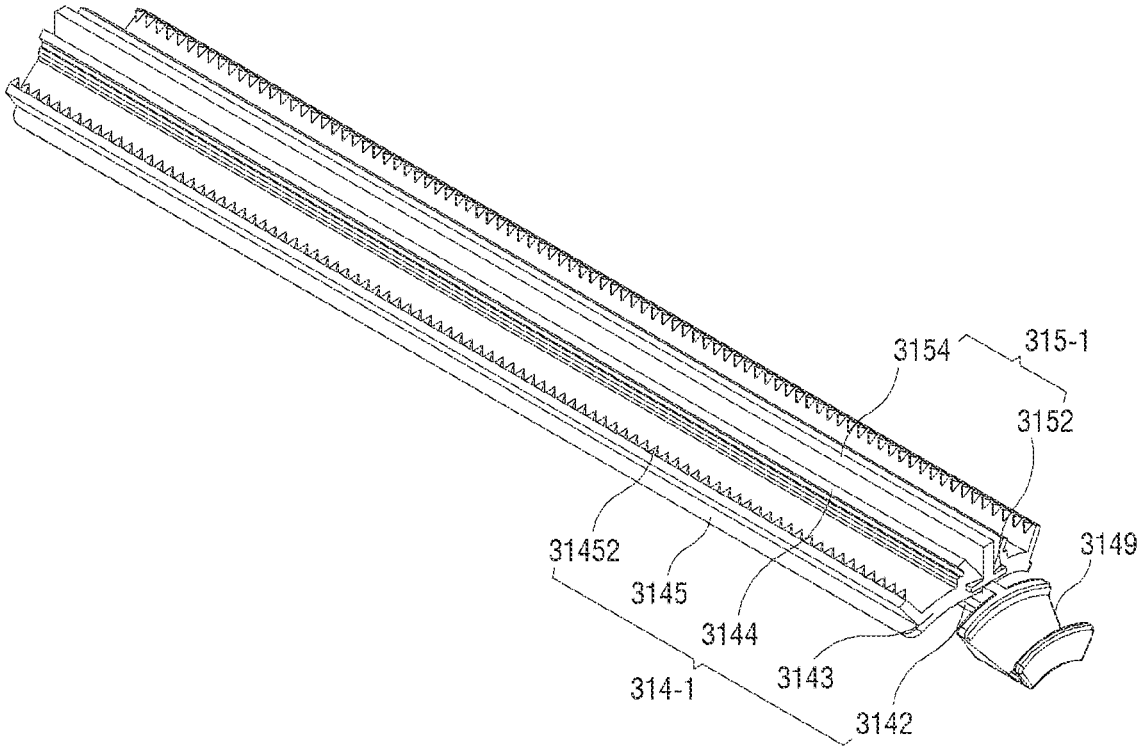
FIG. 12 is a perspective view illustrating a configuration of a blade assembly according to another embodiment of the present disclosure.
Figure 13:
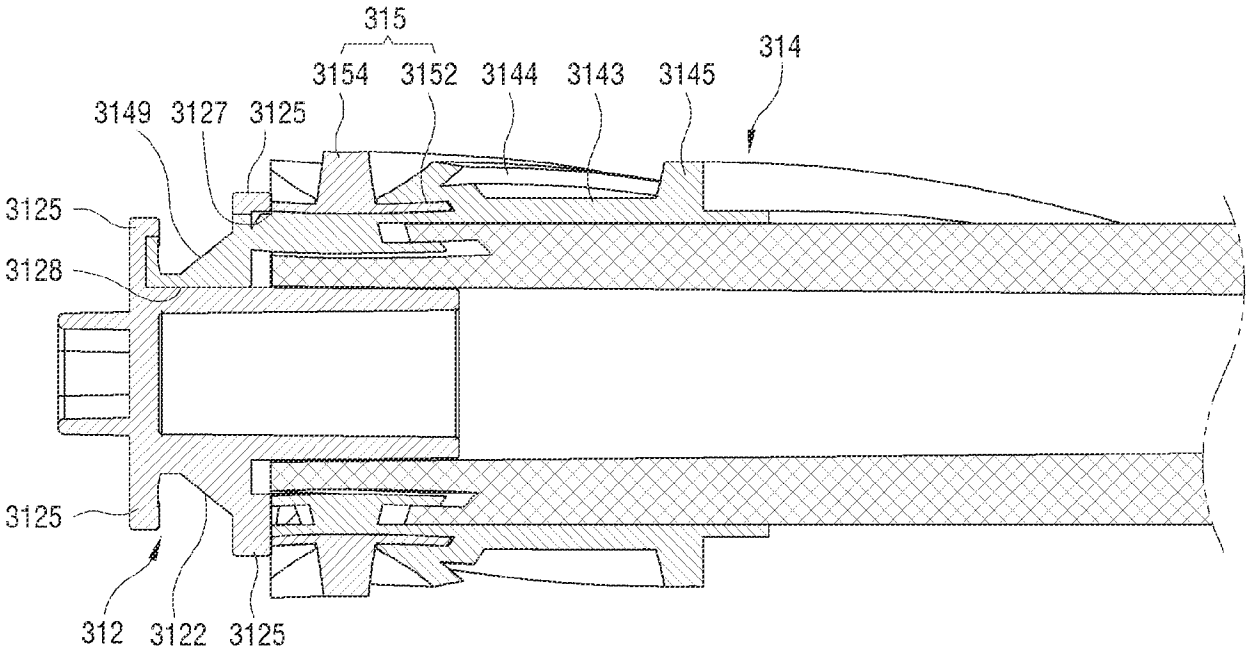
FIG. 13 is a diagram illustrating a state in which the blade assembly of FIG. 10 is mounted.

FIG. 12 is a perspective view illustrating a configuration of the blade assembly 314 according to another embodiment of the present disclosure, and FIG. 13 is a diagram illustrating a state in which the blade assembly 314 of FIG. 10 is mounted.

Referring to FIG. 12, the base part 3143 of the blade assembly 314 may include an extended support part 3149 that is provided at one end portion thereof and is supported by a first drum cap 312. The first drum cap 312 may include an opening 3127 on an inner flange of the pair of second circular flanges 3125 through which the extended support part 3149 passes. The first drum cap 312 may include a recess 3128 in the second valley 3122 into which the extended support part 3149 is inserted.

Referring to FIG. 13, the blade assembly 314 may be completely inserted into the blade mounting parts 3116 and 3118 of the rotating body 311, and then coupled in the recess 3128 of the second valley 3122 by making the extended support part 3149 provided at one end portion of the blade assembly 314 pass through the opening 3127 on the inner flange 3125. In this way, one end portion of the blade assembly 314 may fixedly support the extended support part 3149 to the first drum cap 312.

Figure 14:
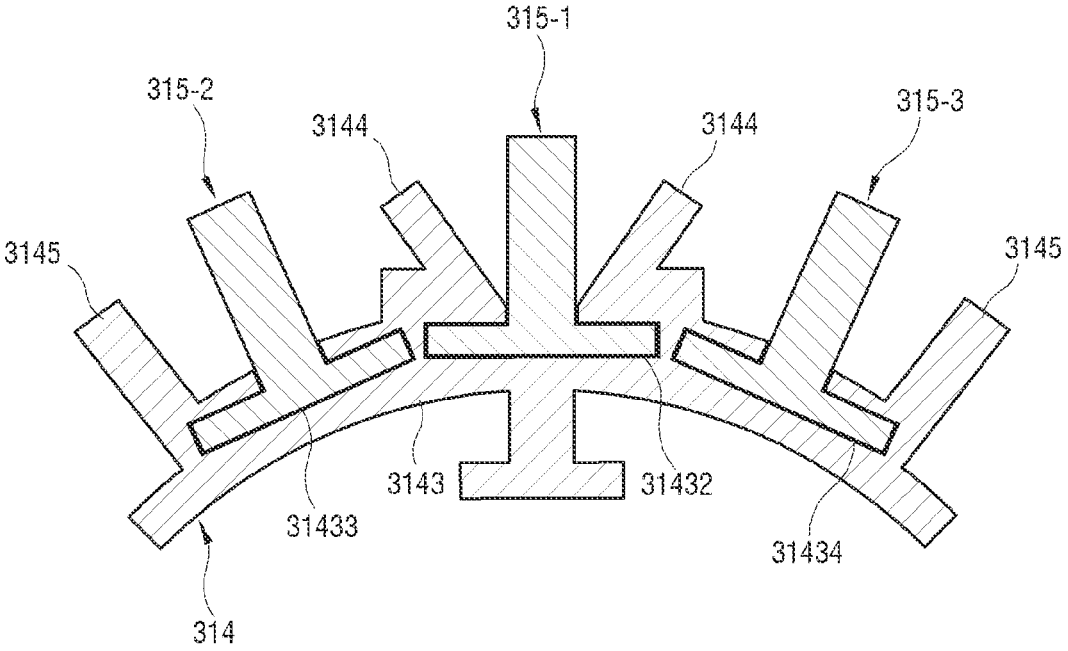
FIG. 14 is a perspective view illustrating a blade assembly according to another embodiment of the present disclosure.

FIG. 14 is a perspective view illustrating the blade assembly 314 according to another embodiment of the present disclosure.

Referring to FIG. 14, the base part 3143 of the blade assembly 314 may include first to third cleaning member support parts 31432, 31433, and 31434 that are spaced apart from each other along the circumferential direction of the rotating body 311. The first cleaning member support part 31432 is provided between the pair of stoppers 3144, and the second and third cleaning member support parts 31433 and 31434 may be provided between the pair of stoppers 3144 and between the pair of blades 3145, respectively.

First to third cleaning members 315-1, 315-2, and 315-3 may be supported by the first to third cleaning member support parts 31432, 31433, and 31434, respectively. The first to third cleaning members 315-1, 315-2, and 315-3 may be made of homogeneous or heterogeneous materials. The first to third cleaning members 315-1, 315-2, and 315-3 may be made of single or mixed cleaning members made of, for example, fabric, rubber (urethane), bristle, carbon, silver, or nylon.

Figure 15:
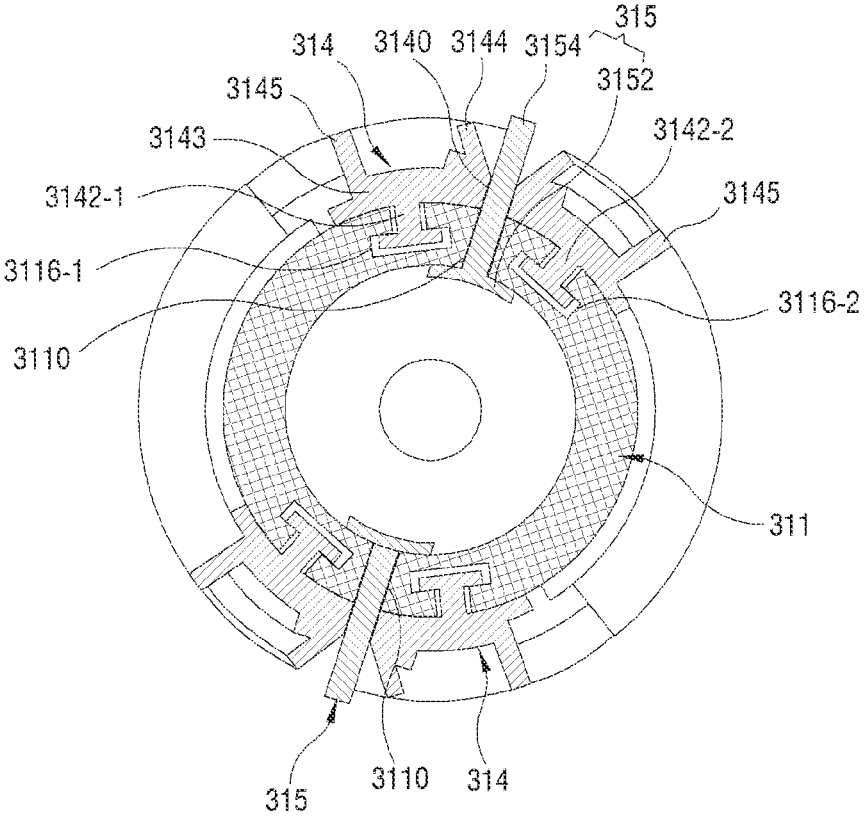
FIG. 15 is a cross-sectional view illustrating the blade assembly according to another embodiment of the present disclosure.

FIG. 15 is a cross-sectional view illustrating the blade assembly 314 according to another embodiment of the present disclosure.

Referring to FIG. 15, the pair of blade assemblies 314 spirally twisted along the rotational shaft direction may be provided on the outer circumferential surface of the rotating body 311. The blade assembly 314 may include two blade support parts 3142-1 and 3142-2 that are inserted into and supported by two blade mounting parts 3116-1 and 3116-2 provided to be spaced apart from each other in a circumferential direction, a second base part 4143 having an arcuate cross section that extends along the outer circumferential surface of the rotating body 311, a pair of stoppers 3144 that is provided in a 'V' shape facing each other in the center of the second base part 4143, and a pair of blades 3145 that is erected to be spaced apart from the pair of stoppers 3144 at second and third intervals, respectively, to the outside of the pair of stoppers 3144 and spirally extends along the rotational shaft direction.

The rotating body 311 may be provided with a first cleaning member passing part 3110 penetrating through the rotating body 311 between the two blade mounting parts 3116-1 and 3116-2. In addition, a second cleaning member passing part 3140 may be provided at a position corresponding to the first cleaning member passing part 3110 in the base part 3143 between the pair of stoppers 3144. The first and second cleaning member passing parts 3110 and 3140 may be formed by a plurality of circular holes or long holes.

The cleaning member 315 may include a support part 3152 and a plurality of hairs or filaments 3154 supported by the support part 3152.

The support part 3152 has an arcuate cross section that comes into contact with and supported by the inner circumferential surface of the rotating body 311 and may extend spirally along the rotational shaft direction. The support part 3152 may be formed to be sufficiently large so that the support part 3152 cannot pass through the first and second cleaning member passing parts 3110 and 3140.

The plurality of hairs or filaments 3154 may protrude between the pair of stoppers 3144 through the first and second cleaning member passing parts 3110 and 3140 inside the rotating body 311.

As described above, according to the vacuum cleaner of the present disclosure, it is possible to simplify the assembling process by assembling, on the drum, the rubber blade assembly into which the cleaning member such as the bristle is inserted in advance and supported, thereby providing the excellent mass productivity.

In addition, according to the vacuum cleaner of the present disclosure, it is possible to improve the cleaning efficiency by mounting various types of cleaning members on the blade assembly alone or in combination according to the cleaning environment.

Moreover, according to the vacuum cleaner of the present disclosure, it is possible to improve the ability to pick up, transfer, and separate the pet or human hair and prevent the hair from becoming tangled by securing an appropriate movable range of the cleaning member during cleaning.

Although the present disclosure has been described with various embodiments, various changes and modifications may be suggested to one skilled in the art. It is intended that the present disclosure encompass such changes and modifications as fall within the scope of the appended claims.

What is claimed is:

1. A vacuum cleaner, comprising:

a cleaner body configured to generate a suction force; and a suctioner comprising a brush drum rotatably provided on a suction port configured to suck foreign objects by the suction force, wherein the brush drum comprises:

a cylindrical drum, a blade assembly provided on the cylindrical drum and extended along a rotational shaft direction, and a cleaning member provided on the blade assembly and configured to clean dust or foreign objects on a cleaning surface, and wherein the blade assembly comprises:

a base part provided on an outer circumferential surface of the cylindrical drum, a cleaning member support part provided in the base part and configured to accommodate and support a portion of the cleaning member, and a stopper provided in the base part near the cleaning member at intervals and configured to restrict the cleaning member from being deformed in an opposite direction to a rotational direction of the brush drum.

2. The vacuum cleaner of claim 1, wherein:

the stopper has a support surface configured to face the cleaning member, and wherein an interval between the cleaning member and the support surface of the stopper is configured to gradually widen in a radial direction of a rotating shaft.

3. The vacuum cleaner of claim 1, wherein a height in a radial direction of a rotating shaft of the cleaning member is higher than the stopper.

4. The vacuum cleaner of claim 1, wherein a length in the rotational shaft direction of the cleaning member is longer than the stopper.

5. The vacuum cleaner of claim 1, wherein the stopper comprises a pair of stoppers spaced apart from each other, and wherein the cleaning member is provided between the pair of stoppers.

6. The vacuum cleaner of claim 1, wherein the cleaning member is provided as a plurality of cleaning members, and wherein the cleaning member support part comprises a plurality of cleaning member passing parts into which the plurality of cleaning members are inserted.

7. The vacuum cleaner of claim 1, wherein the blade assembly further comprises at least one blade spaced apart from the stopper.

8. The vacuum cleaner of claim 7, wherein an end portion of the at least one blade is provided with a protrusion that protrudes in the rotational direction or a reverse direction thereto.

9. The vacuum cleaner of claim 1, wherein the cleaning member is provided as a plurality of cleaning members, and wherein the cleaning member support part is provided as a plurality of cleaning member support parts spaced apart from each other in a circumferential direction to support the plurality of cleaning members, respectively.

10. The vacuum cleaner of claim 9, wherein the plurality of cleaning members are a same type of cleaning member or are different types of cleaning members.

11. The vacuum cleaner of claim 10, wherein the plurality of cleaning members comprises a cleaning member that is made of a single material of fabric, rubber, bristle, carbon, nylon, or silver.

12. The vacuum cleaner of claim 10, wherein the plurality of cleaning members comprises a cleaning member that is made of a mixed material of fabric, rubber, bristle, carbon, nylon, or silver.

13. The vacuum cleaner of claim 1, wherein the blade assembly is configured to spirally extend along the rotational shaft direction, wherein the blade assembly comprises a blade support part accommodated and supported in the cylindrical drum, and wherein a base part is configured to:

extend along a circumferential direction of the cylindrical drum and the rotational shaft direction from the blade support part to contact the outer circumferential surface of the cylindrical drum, and support the stopper.

14. The vacuum cleaner of claim 13, wherein the brush drum further comprises drum caps that are coupled to both end portions of the cylindrical drum, and wherein an end portion of the base part is provided with an extended support part that is supported by the drum cap.

15. The vacuum cleaner of claim 13, wherein both end portions of the base part of the blade assembly adhere to the outer circumferential surface of the cylindrical drum.

16. The vacuum cleaner of claim 13, wherein the base part of the blade assembly has an arcuate cross section that extends in the circumferential direction of the cylindrical drum.

17. The vacuum cleaner of claim 13, wherein the cleaning member support part comprises a groove part having a "reverse T"-shaped cross section that extends along an extending direction of the blade assembly in the base part.

18. The vacuum cleaner of claim 17, wherein the stopper comprises a locking jaw to which the cleaning member support part is locked in a radial direction of a rotating shaft from the groove part.

19. The vacuum cleaner of claim 17, wherein the cleaning member comprises:

a support part inserted into the groove part; and a plurality of hairs or filaments supported by the support part and configured to protrude therefrom.

20. The vacuum cleaner of claim 19, wherein the support part has both end portions in the circumferential direction that have a thickness thinner than a central portion between the both end portions.

* * * * *